US008833118B1

(12) United States Patent
McLane

(10) Patent No.: US 8,833,118 B1
(45) Date of Patent: Sep. 16, 2014

(54) PORTABLE DRAWER AND DOOR LOCK FOR RETROFIT APPLICATIONS

(76) Inventor: James E. McLane, Tarpon Springs, FL (US)

( * ) Notice: Subject to any disclaimer, the term of this patent is extended or adjusted under 35 U.S.C. 154(b) by 94 days.

(21) Appl. No.: 13/398,087

(22) Filed: Feb. 16, 2012

Related U.S. Application Data

(60) Provisional application No. 61/470,716, filed on Apr. 1, 2011, provisional application No. 61/443,924, filed on Feb. 17, 2011.

(51) Int. Cl.
*E05B 65/46* (2006.01)

(52) U.S. Cl.
USPC ..... 70/85; 70/78; 70/81; 70/86; 70/257; 70/278.7; 70/280; 70/282; 70/451; 70/461; 292/144; 292/DIG. 53; 292/DIG. 60; 248/229.15; 248/229.25; 248/231.71; 312/215

(58) Field of Classification Search
CPC ..... E05B 65/46; E05B 65/461; E05B 65/462; E05B 65/44; E05B 9/08; E05B 63/0017; E05B 65/0025; E05B 65/02; E05B 9/00; E05B 47/0012; E05B 47/002; E05B 47/026; E05B 47/0004; E05B 2047/0002; E05B 2047/0086
USPC ..... 70/278.7, 374, 451, 461, 257, 277, 70/279.1, 280–282, 77–88; 292/144, 292/DIG. 53, DIG. 60, DIG. 64; 248/229.15, 248/229.25, 231.71; 312/215, 222
See application file for complete search history.

(56) References Cited

U.S. PATENT DOCUMENTS

| | | | | | |
|---|---|---|---|---|---|
| 963,451 | A | * | 7/1910 | Lowe | 70/452 |
| 1,118,303 | A | * | 11/1914 | Meyer | 70/448 |
| 2,034,589 | A | * | 3/1936 | Meilink | 70/85 |
| 2,508,159 | A | * | 5/1950 | Haas | 221/15 |
| 3,926,019 | A | * | 12/1975 | Mazeika | 70/85 |
| 4,509,347 | A | * | 4/1985 | Young | 70/129 |
| 4,694,668 | A | * | 9/1987 | Ciletti et al. | 70/63 |
| 4,703,850 | A | * | 11/1987 | Walker | 206/293 |
| 4,799,719 | A | * | 1/1989 | Wood | 292/144 |
| 4,909,052 | A | * | 3/1990 | Hutwohl | 70/63 |
| 5,027,948 | A | * | 7/1991 | Forbes et al. | 206/387.11 |
| 5,206,637 | A | * | 4/1993 | Warren | 340/5.22 |
| 5,546,777 | A | * | 8/1996 | Liu et al. | 70/257 |
| 5,590,608 | A | * | 1/1997 | Yore et al. | 109/50 |
| 5,624,071 | A | * | 4/1997 | Sosan | 232/17 |
| 5,626,039 | A | * | 5/1997 | Solari et al. | 70/279.1 |
| 5,791,179 | A | * | 8/1998 | Brask | 70/278.1 |

(Continued)

*Primary Examiner* — Lloyd Gall
(74) *Attorney, Agent, or Firm* — Ronald E. Smith; Smith & Hopen, P.A.

(57) ABSTRACT

A lock for retrofitting onto a drawer or a door includes a drawer having a front panel. The drawer slidingly engages an item of furniture having a front face that is positioned above the front panel when the drawer is closed. A bracket has a vertically disposed flat front plate, a horizontally disposed flat top plate, a vertically disposed flat back plate, and a horizontally disposed motor platform that extends horizontally into an interior of the drawer. A motor having an output shaft is mounted on the motor platform. A latch supported by the motor platform is engaged by the output shaft. The latch is retracted when the drawer is unlocked and is extended to engage an interior side of the front panel of the furniture item when the drawer is locked.

18 Claims, 11 Drawing Sheets

(56) References Cited

U.S. PATENT DOCUMENTS

| | | | | |
|---|---|---|---|---|
| 5,862,693 | A * | 1/1999 | Myers et al. | 70/278.1 |
| 5,941,106 | A * | 8/1999 | Williamson et al. | 70/278.1 |
| 6,330,816 | B1 * | 12/2001 | O'Connor | 70/63 |
| 6,412,317 | B1 * | 7/2002 | Martin | 70/81 |
| 7,059,159 | B2 * | 6/2006 | Lanigan et al. | 70/280 |
| 7,096,697 | B2 * | 8/2006 | Keightly | 70/279.1 |
| 7,484,391 | B1 * | 2/2009 | Moore | 70/257 |
| 8,544,899 | B2 * | 10/2013 | Hertrich | 292/195 |

* cited by examiner

PORTABLE DRAWER AND DOOR LOCK FOR RETROFIT APPLICATIONS

CROSS-REFERENCE TO RELATED APPLICATIONS

This nonprovisional patent application is a continuation of and claims priority to provisional patent application No. 61/470,716, entitled "UNIVERSAL DRAWER AND DOOR LOCK SYSTEM THAT CLAMPS ON BY TIGHTENING A THUMB SCREW TO SECURE AND DOES NOT DAMAGE SURFACE AND MAKES IT EASY TO REMOVE AND PLACE ON ANOTHER DRAWER," filed Apr. 1, 2011 by the same inventor. This nonprovisional patent application is also a continuation of and claims priority to provisional patent application No. 61/443,924, entitled "DRAWER & DOOR LOCK THAT CLAMPS ON BY TIGHTENING A SCREW TO SECURE AND DOES NOT DAMAGE SURFACE AND MAKES IT EASY TO REMOVE AND PLACE ON ANOTHER DRAWER," filed Feb. 17, 2011 by the same inventor.

BACKGROUND OF THE INVENTION

1. Field of the Invention

This invention relates to locking devices. More specifically, it relates to a lock that can be retrofit onto a door or drawer that was manufactured without a lock.

2. Brief Description of the Related Art

Locks that can be added to a drawer or door are known, but they require the use of tools and sometimes they require complex assembly steps which might damage the cabinet such as drilling holes, adding screws or other fastening means, and the like.

Accordingly, there is a need for a lock that can be retrofit onto a drawer or door that does not require tools and which can be attached to the door in the absence of assembly steps.

Such a lock would be useful for travelers who need to lock a drawer in a hotel room, for example. It would also have utility in non-travel applications as well, such as a need to lock a drawer in a home.

However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for a portable drawer and door lock for use in retrofit applications is now met by a new, useful, and nonobvious invention.

The novel structure is a portable drawer or door lock that is retrofit onto a drawer or a door. The novel lock is adapted to releasably engage a front panel of a conventional drawer having a vertical front panel. The drawer is adapted to slidingly engage an item of furniture such as a cabinet having a front panel, said cabinet front panel referred to hereinafter as a front face to avoid confusion with the front panel of the drawer.

The lock includes a bracket having a vertically disposed flat front plate adapted to overlie a predetermined section of the front surface of the front panel of the drawer, a horizontally disposed flat top plate adapted to overlie a horizontal top edge of the front panel, and a vertically disposed flat back plate adapted to overlie a predetermined section of an interior surface of the front panel.

A latch is connected to the bracket and is disposed within an interior of the drawer. The latch has a retracted position when the drawer is unlocked and an extended position when the drawer is locked. The latch substantially abuts the interior surface of the front face of the cabinet when the latch is in its extended position.

A latch actuator is connected to the bracket, is disposed within an interior of the drawer, and is manually inoperable when the drawer is closed.

A control device is in electrical communication with the latch actuator. The latch actuator extends the latch upon receipt of an "extend latch" signal from the control device and the actuator retracts the latch upon receipt of a "retract latch" signal from the control device.

The actuator may be provided in the form of a motor having an output shaft. The latch is engaged by the output shaft so that activation of the motor causes displacement of the latch from its retracted position to its extended position or from its extended position to its refracted position.

The actuator may also be provided in the form of an electromechanical solenoid having an armature. The latch is engaged by the armature so that activation of the solenoid causes displacement of said latch from its retracted position to its extended position or from its extended position to its retracted position.

An opening is formed in the vertically disposed flat back plate of the bracket and a thumb screw disposed in the opening engages the vertically disposed flat back plate when tightened so that the said bracket fits over the front panel and is secured thereto in the absence of tools. Of course, the scope of this invention also includes the use of screws or other fastening means that require tools but such embodiments are not the preferred embodiments.

A spacer is disposed in surmounting relation to the latch and releasably engages the latch in non-rotating relation thereto. The spacer has a first part that engages the latch and a second part that extends horizontally from the latch to an interior wall of the front face of the cabinet when the latch and the interior wall of the front face are horizontally spaced apart from one another.

In a preferred embodiment, the spacer has a "T"-shape and the latch has a generally square transverse cross-section with a non-round bore formed therein coincident with a longitudinal axis of the latch. The first part of the spacer is a non-round rod that is slideably received within the non-round bore in a first position where a first edge of the spacer is aligned with a first sidewall of the latch, the non-round rod also being slideably received within the non-round bore in a second position where a second edge of the spacer is aligned with a second sidewall of the latch, the non-round rod also being slideably received within the non-round bore in a third position where a third edge of the spacer is aligned with a third sidewall of the latch, and the non-round rod also being slideably received within the non-round bore in a fourth position where a fourth edge of the spacer is aligned with a fourth sidewall of the latch.

The motor may take the form of a linear motor that extend the latch when operating in a first linear mode and retracts the latch when operating in a second linear mode.

In another embodiment, the latch is internally threaded and an externally threaded rod is secured to the output shaft of the motor for conjoint rotation therewith. The externally threaded rod engages internal threads formed in the latch so that the latch is extended when the output shaft rotates in a first direction and the latch is retracted when the output shaft rotates in a second direction opposite to the first direction.

In a further embodiment, a horizontally disposed platform is connected to the vertically disposed flat back plate and extends horizontally into an interior of the drawer for a predetermined distance and the actuator is mounted on the horizontally disposed platform.

A spring is preferably positioned between the motor platform and the motor so that the motor is supported in a position of repose by the spring when the spring is in its position of repose so that if the latch is obstructed and cannot be extended into its door-locking configuration, the motor is driven against the bias of the spring so that the motor is not damaged.

In yet another embodiment, an externally threaded rod is secured to the output shaft of the motor for conjoint rotation therewith. A plurality of rack teeth is formed in the latch and a pinion gear is disposed in meshing engagement with the rack teeth and the external threads formed in the rod.

A control device sends "extend latch" and "retract latch" signals in all embodiments. For example, when the latch actuator is a solenoid, the latch is secured to the armature of the solenoid for conjoint movement therewith and the armature extend and retracts to "extend latch" and "retract latch" signals from the control device.

The control device is mounted within a control housing that includes a battery compartment. The control housing is mounted in abutting relation to the exterior wall of the vertically disposed front panel of the drawer, and includes a user interface. In a preferred embodiment, the user interface is a keypad having a plurality of keys. The control housing including a controller that receives input from the keypad and produces output signals based upon the input.

A "program set" button projects from an interior face of the control housing and is biased so that it is depressed when the control housing is placed into its operative position relative to the front panel of the drawer and so that the "program set" button returns to a position of repose when the control housing is removed from the front panel.

In another latch arrangement, instead of extending from a retracted position to an extended position by following a straight path of travel, the lowermost end of the latch is secured to the output shaft of the motor so that when the motor rotates ninety degrees (90°) in a first direction responsive to an "refract latch" output signal from the control housing, the latch pivots about said lowermost point and rotates from a vertical position to a horizontal position, thus unlocking the drawer. The rotates ninety degrees) (90° about said lowermost point in a second direction opposite to the first direction, i.e., from said unlocked, horizontal position to its upright, vertical locked position when the motor is activated by an "extend latch" output signal from the control housing.

The bracket has a slightly different configuration when locking a drawer having a front panel reinforced by a second panel that is secured to an interior surface of the front panel. In that environment, the bracket has a vertically disposed flat front plate adapted to overlie a predetermined section of the front surface of the front panel, a horizontally disposed flat top plate adapted to overlie the horizontal top edge of the front panel, a vertically disposed flat back plate adapted to overlie a predetermined extent of a back surface of the front panel, a horizontally disposed flat top plate adapted to overlie a horizontal top edge of the second panel, and a vertically disposed flat back plate adapted to overlie a predetermined extent of the interior surface of the second panel. In all other respects, the novel lock has the same structure when used with drawers having single panels or double panels.

When used to lock a door, the novel structure includes a bracket having a flat front plate adapted to overlie a predetermined section of a front surface of the door, a flat plate adapted to overlie an edge of the door, and a flat back plate adapted to overlie a predetermined extent of a back surface of the door. The bracket is secured to the door as in the drawer embodiments and a latch has a first position where it is retracted relative to the bracket and a second position where it is extended relative to the bracket as in the drawer embodiments. The latch engages a wall or a door jamb when extended so that the door cannot be opened and the latch does not engage a wall or door jamb when retracted so that the door can be opened. The same structural details and means for operating the latch as disclosed in connection with the drawer embodiments apply as well to the door embodiments.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1A:
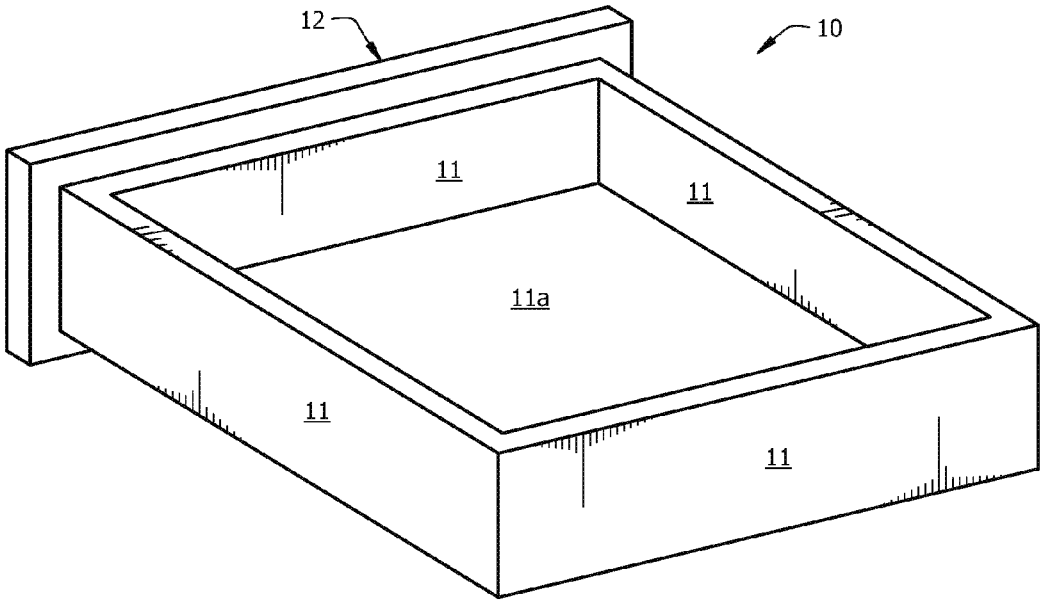
FIG. 1A (Prior Art)
FIG. 1A is a perspective view of a drawer of the type that can be locked with the inventive structure.

FIG. 1A depicts a conventional, prior art drawer as a whole by the reference numeral 10. The front panel of drawer 10 is denoted 12. The four sidewalls of drawer 10 are collectively denoted 11 and the bottom wall of drawer 10 is denoted 11*a*. Sidewall 11 that abuts the interior wall of front panel 12 is of course secured to said interior wall.

There are two common types of drawers and two common types of cabinets that slideably receive said drawers in well-known ways.

Figure 1B:
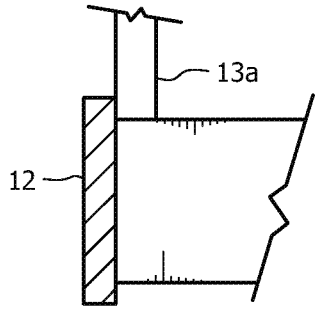
FIG. 1B (Prior Art)
FIG. 1B is a diagrammatic side elevational view of an exterior drawer installed in a cabinet having a single face.
Figure 1C:
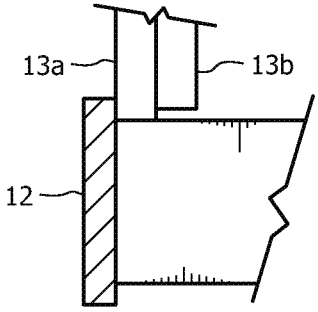
FIG. 1C (Prior Art)
FIG. 1C is a diagrammatic side elevational view of an exterior drawer installed in a cabinet having a double face.

The first type of drawer is an external drawer and is depicted in FIGS. 1B and 1C. The second type of drawer is a flush-mounted drawer and is depicted in FIGS. 1D and 1E.

Figure 1D:
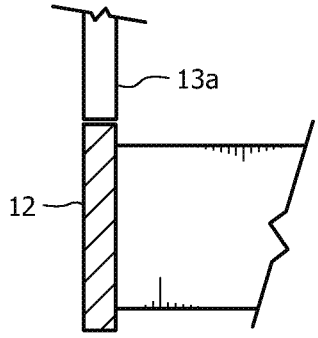
FIG. 1D (Prior Art)
FIG. 1D is a diagrammatic side elevational view of a flush-mounted drawer installed in a cabinet having a single face.

The first type of cabinet has a single panel and is depicted in FIGS. 1B and 1D. The second type of cabinet has a double panel and is depicted in FIGS. 1C and 1E.

Figure 1E:
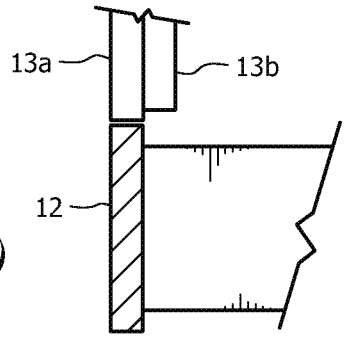
FIG. 1E (Prior Art)
FIG. 1E is a diagrammatic side elevational view of a flush-mounted drawer installed in a cabinet having a double face.

Thus it is understood that FIG. 1B depicts an external drawer having front panel 12 that abuts single cabinet face 13*a*, FIG. 1C depicts an external drawer having front panel 12 that abuts first cabinet face 13*a* that is reinforced by second cabinet face 13*b*, FIG. 1D depicts a flush mounted drawer having front panel 12 disposed in co-planar relationship with single cabinet face 13*a*, and FIG. 1E depicts a flush-mounted drawer having front panel 12 disposed in co-planar relationship with single cabinet face 13*a* that is reinforced by second cabinet face 13*b*.

A latch positioned so that it substantially abuts the interior surface of cabinet face 13*b* in FIG. 1C will require an extension, or spacer, in order to reach the interior surface of panel 13*a* in the embodiment of FIG. 1B. The term "substantially abuts" includes a physical touching as well as a closely spaced apart relationship between an extended latch and the interior surface of a cabinet face.

A latch that abuts the interior surface of cabinet face 13*b* in FIG. 1E will require an extension, or spacer, in order to reach the interior surface of panel 13*a* in the embodiment of FIG. 1D.

In other words, in order to provide a locking mechanism that fits almost all drawers, a latch is positioned a predetermined distance from the interior side of front panel 12 of an externally-mounted drawer 10 so that the latch will be flush with the interior surface of cabinet face 13*b* when said latch is deployed, there being no need for a spacer in that FIG. 1C configuration. Various spacer means of differing lengths are provided to fill the space between said latch at said predetermined distance and the interior surface of cabinet face 13*a* or 13*b* in the configurations of FIGS. 1A, 1D, and 1E.

Figure 2A:
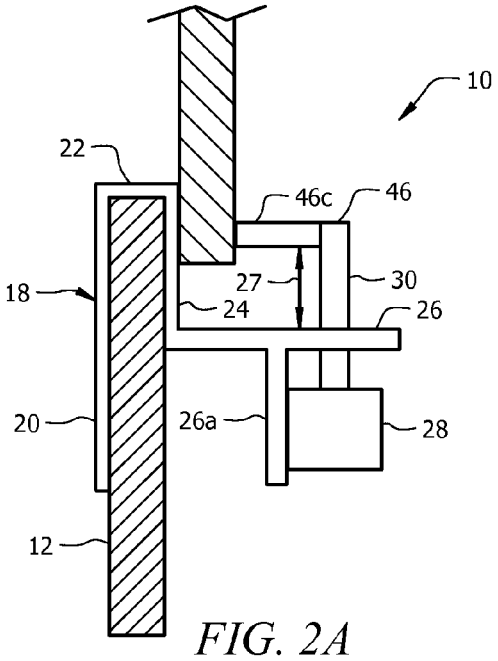
FIG. 2A is a side elevational view of a first embodiment with the main lock body removed to simplify the drawing.

FIG. 2A depicts an exterior drawer and a single cabinet face 13*a* as diagrammatically depicted in FIG. 1B. Drawer 12 must be opened before the novel retrofit lock, denoted 16 as a whole, can be installed. Lock 16 includes bracket 18 and several parts that are mounted to said bracket. Bracket 18 is a one-piece, i.e., integrally formed member in this embodiment.

More particularly, bracket 18 includes vertically disposed flat front plate 20 that overlies in part the front, exterior surface of front panel 12 of drawer 10, horizontally disposed flat top plate 22 that overlies the horizontal top edge of drawer front panel 12, vertically disposed flat back plate 24 that overlies part of the back or interior surface of front panel 12, horizontally disposed platform 26 that extends horizontally into the interior of the drawer for a predetermined distance, and vertically disposed wall 26*a* to which is mounted motor 28. Flat back plate 24 may be lengthened to share a common vertical extent with flat front plate 20 so that bracket 18 is even more snugly and stably secured to front drawer panel 12.

In the embodiment of FIG. 2A, motor 28 is a linear motor that extends and retracts latch 30 as indicated by double-headed directional arrow 27. An opening is formed in platform 26 to enable such extending and retracting of latch 30. Horizontally disposed spacer 44 having flat wall 46 surmounts latch 30 and has an extension 46*c*, hereinafter referred to as second arm 46*c*, that abuts the interior surface of single cabinet face or wall 13*a* when said latch is extended as depicted.

Figure 2B:
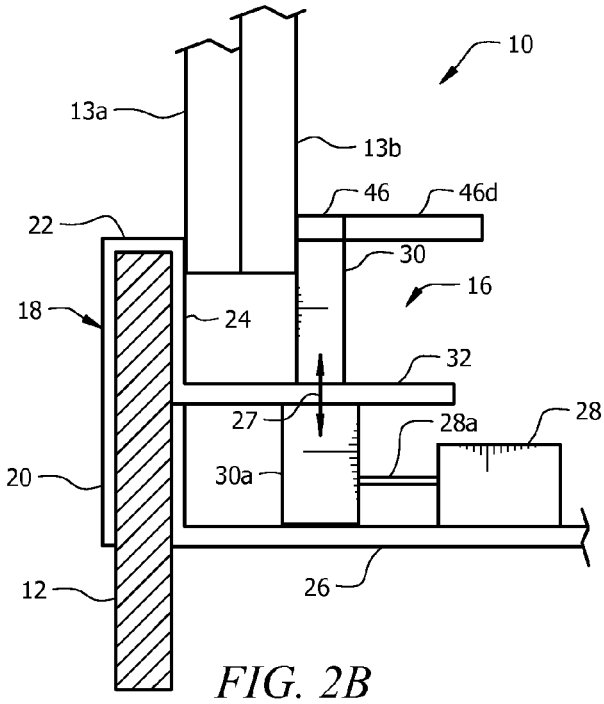
FIG. 2B is a side elevational view similar to FIG. 2A but depicting an alternate mounting of the motor.

In the embodiment of FIG. 2B, drawer 10 is externally mounted and the cabinet face includes first and second cabinet faces 13*a* and 13*b* as diagrammatically depicted in FIG. 1C. The motor-mounting structure could be the same as that of FIG. 2A, with no spacer being required if the combined thicknesses of cabinet faces 13*a*, 13*b* results in a flush contact with latch 30 when said latch is extended.

However, in order to accommodate all configurations, the novel lock assembly includes a spacer that can be rotated to provide a flush surface when no extension is needed. In FIG. 2B where no extension is needed, spacer 44 is rotated so that its longest extension 46*d*, hereinafter referred to as third arm 46*d*, extends away from cabinet faces or walls 13*a*, 13*b*. This aligns spacer 44 in flush relation to the interior surface of cabinet face or wall 13*b* as depicted. Accordingly, both spacer 44 and latch 30 abut interior surface of cabinet face or wall 13*b*.

FIG. 2B depicts a different structure from FIG. 2A just to indicate that a wide variety of structural arrangements can be employed, i.e., there is no requirement that motor 28 be secured to vertical wall 26*a* as in FIG. 2A, or that motor 28 be a linear motor, for example.

In FIG. 2B, motor 28 having output shaft 28*a* and latch 30 that extends from and retracts into housing 30*a* are mounted on horizontal motor platform 26. Latch 30 is depicted in its extended drawer-locking position. When latch 30 is in a retracted configuration, the drawer is unlocked, free to open and close. Latch 30 extends upwardly when motor 28 receives an "extend latch" signal so that the upper end of said latch is positioned behind cabinet face 13*b*, thereby preventing opening of the drawer.

Latch 30 extends through an opening formed in secondary plate 32 that extends horizontally into the interior of the drawer in parallel relation to motor platform 26 in vertically spaced relation thereto. Secondary plate 32 provides support for latch 30 when said latch is in its extended position. Without secondary plate 32, a user could pull on the drawer with great force and perhaps cause latch 30 to bend away from cabinet panels 13*a*, 13*b*, allowing the drawer to open.

There are numerous ways to extend and retract latch 30 and all of said ways are within the scope of this invention. For example, motor 28 could be provided in the form of a linear motor in linear alignment with latch 30 as depicted in FIG. 2A as aforesaid and as depicted in further detail in FIG. 3. Latch 30 in this embodiment is internally threaded and said internal threads engage external threads formed in rod 34 that is mounted to output shaft 28*a* for conjoint rotation therewith. Accordingly, rotation of output shaft 28*a* in a first direction, responsive to a "lock drawer/extend latch" signal, extends latch 30 and rotation of output shaft 28*a* in a second direction opposite to said first direction, responsive to an "unlock drawer/retract latch" signal, retracts said latch 30.

Figure 3:
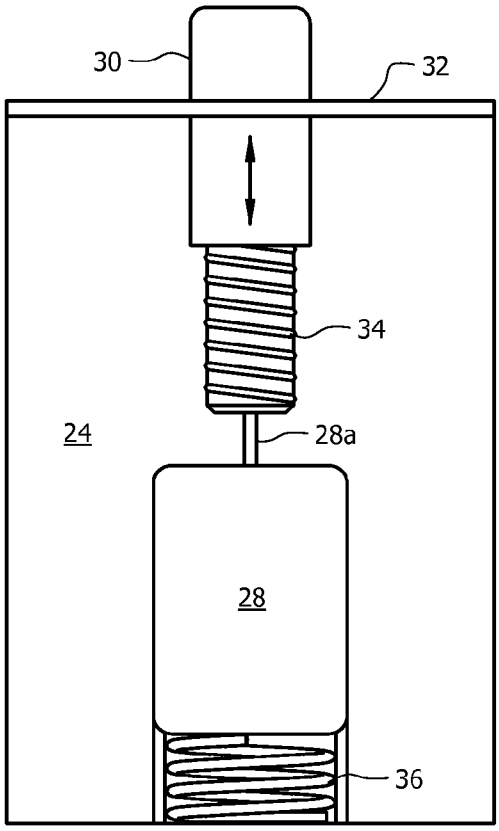
FIG. 3 is a front elevational view of a first latch activation means.

Spring 36 may be positioned between motor platform 26 and motor 28 as depicted in FIG. 3. Motor 28 is biased in an uplifted position by said spring so that if latch 30 is obstructed and cannot be extended into its door-locking configuration, the motor is driven downwardly against the bias of spring 36 so that the motor is not destroyed.

Figure 4:
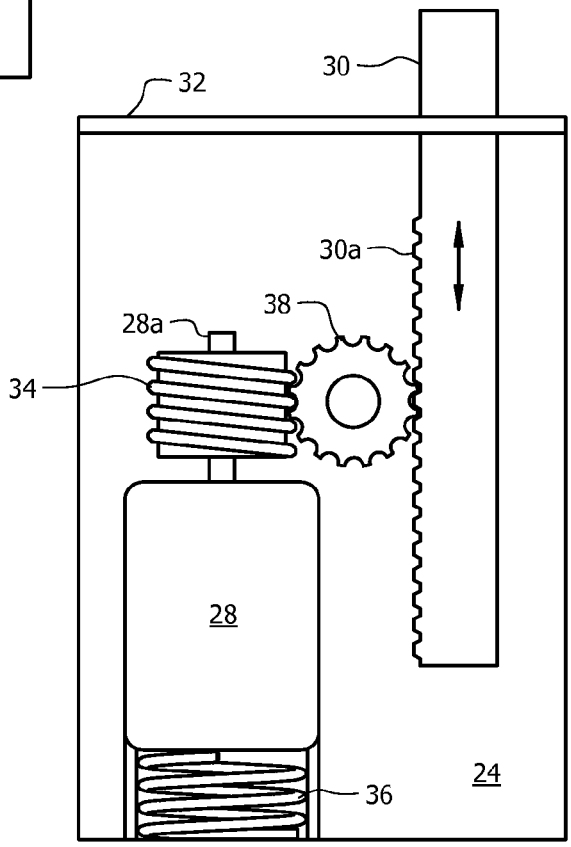
FIG. 4 is a front elevational view of a second latch activation means.

A rack and pinion arrangement is depicted in FIG. 4. Rack teeth 30*a* are formed in latch 30 and said teeth are engaged by pinion gear 38 that engages external threads of helical gear 34, said gear rotating conjointly with output shaft 28*a*. Motor 28 is bi-directional in all embodiments.

Figure 5:
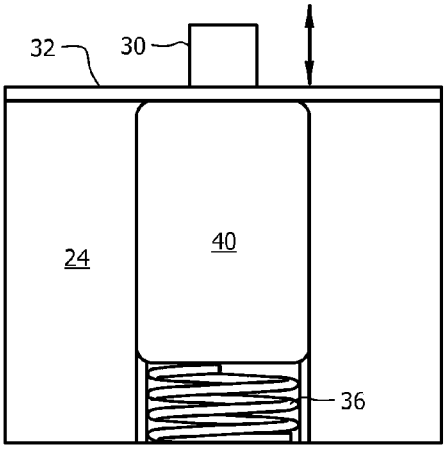
FIG. 5 is a front elevational view of a third latch activation means.

In yet another embodiment, depicted in FIG. 5, solenoid 40 extends and retracts latch 30 in response to "extend latch" and "refract latch" signals.

No spacer is depicted in FIGS. 3-5 because said figures do not include cabinet faces 13*a*, 13*b* but it should be understood that a spacer is used in all embodiments, including flush-mounted embodiments where the spacer is rotated into a non-operable position as mentioned above in connection with FIG. 2B.

Figure 6A:
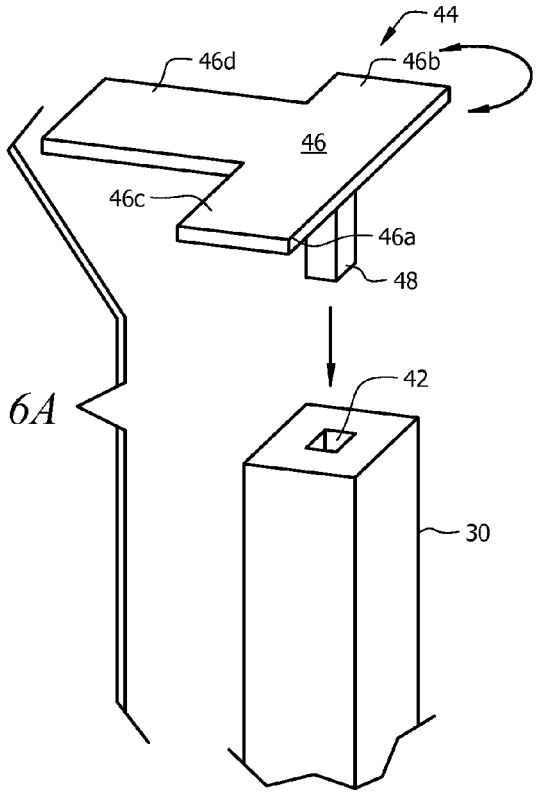
FIG. 6A is an exploded perspective view of a latch spacer means.
Figure 6B:
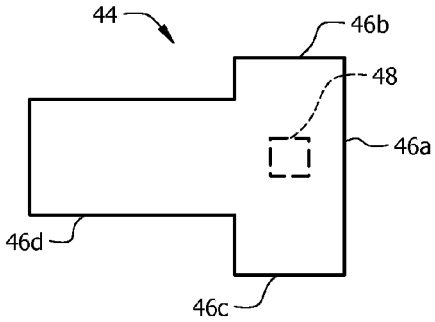
FIG. 6B is a top plan view of the spacer means of FIG. 6A.

Spacer 44 is disclosed in greater detail in FIGS. 6A and 6B. Square bore 42 is formed in latch 30, said bore being centered about the longitudinal axis of symmetry of latch 30. Spacer device 44 includes a flat top plate and square peg 48 that is secured thereto or formed integrally therewith in depending relation thereto. The extent of square peg 48 is less than the extent of bore 42 and said square peg can be easily inserted into and withdrawn from said bore.

Flat top plate 46 is "T"-shaped and has first arm 46*a* having no length so that it is flush with a first sidewall of latch 30, a second arm 46*b* that extends three eighths of an inch (⅜") beyond a second sidewall of latch 30, a third arm 46*c* that extends five eighths of an inch (⅝") beyond a third sidewall of latch 30, and a fourth arm 46*d* that extends one and three eighths of an inch (1⅜") beyond a fourth sidewall of latch 30.

When exterior drawer 12 abuts the exterior surface of cabinet face or wall 13*a*, as depicted in FIG. 1B, top plate 46 is rotated so that third arm 46*c* is placed flush against said interior surface of cabinet face or wall 13*a* as depicted in FIG. 2A.

When an exterior door abuts the interior surface of cabinet face panel 13*a* only, as depicted in FIG. 1B, top plate 46 is rotated so that third edge 46*c* is placed flush against said interior surface of panel 13*a* as depicted in FIG. 2A.

When an exterior drawer abuts first panel face 13*a* which is reinforced by second panel face 13*b*, as depicted in FIG. 1C, top plate 46 is rotated so that first, flush edge 46*a* is placed flush with the interior surface of panel 13*b* as depicted in FIG. 2B.

Figure 8A:
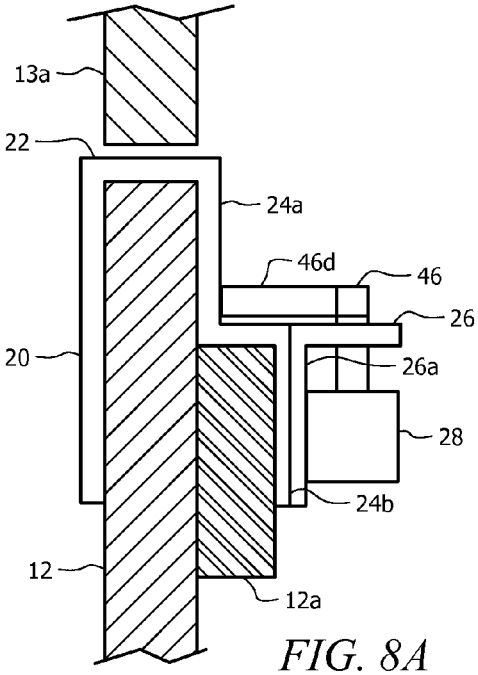
FIG. 8A is a side elevational view of an embodiment where the drawer front panel is reinforced with a second panel secured to the interior wall of the front panel and where there is one cabinet face.

When a flush-mounted drawer is co-planar with cabinet face 13*a*, as depicted in FIG. 1D, top plate 46 is rotated so that fourth edge 46*d* is placed flush against the interior surface of panel 13*a* as depicted in FIG. 8A.

Figure 8B:
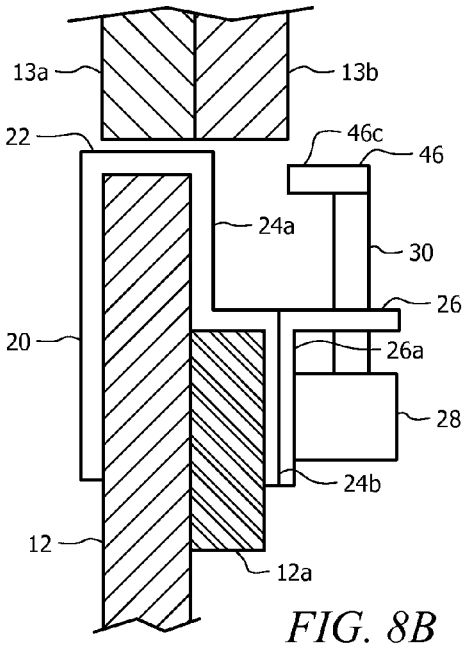
FIG. 8B is a side elevational view of an embodiment where the drawer front panel is reinforced with a second panel secured to the interior wall of the front panel and where there are two abutting cabinet faces.

When a flush-mounted drawer 12 is co-planar with first cabinet face or wall 13*a* which is reinforced by second cabinet face or wall 13*b*, as depicted in FIG. 1E, top plate 46 is rotated so that third arm 46*c* is placed flush against the interior surface of cabinet face or wall 13*b* as depicted in FIG. 8B.

Figure 6C:
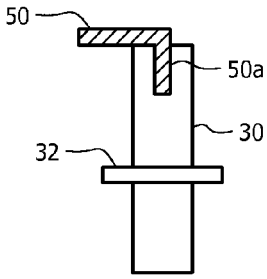
FIG. 6C is a side elevational view of a second embodiment of a latch spacer.

In a less versatile alternative spacing means for accommodating cabinet faces of varying thicknesses, right-angled spacers of various sizes may be employed, one of such spacers being denoted 50 in FIG. 6C.

Vertical part 50*a* of said spacer is received in bore 42 formed in latch 30 and the horizontal part extends beyond the sidewall of latch to the nearest cabinet face by five-eighths of an inch (⅝") for a first spacer in the embodiment of FIG. 1B.

No spacer is needed for the embodiment of FIG. 1C. The provided spacer is rotated one hundred eighty degrees (180°) from the FIG. 6C position, i.e., spacer 44 in FIG. 6C extends to the right when latch 30 is used in the FIG. 1C embodiment so that latch 30 may abut the interior surface of cabinet face or wall 13*b*.

The horizontal part extends one and three-eighths of an inch (1⅜") for a spacer in the embodiment of FIG. 1D.

The horizontal part extends five-eighths of an inch (⅝") for a spacer in the embodiment of FIG. 1E.

Figure 7:
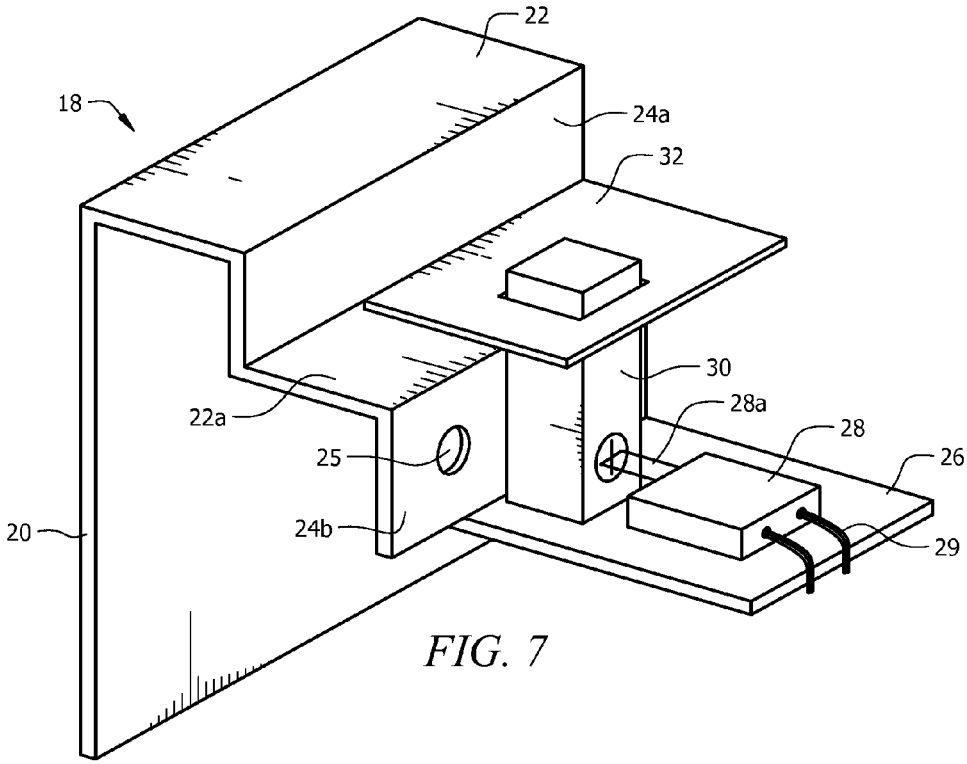
FIG. 7 is a perspective view of an embodiment where the drawer front panel is reinforced by a second front panel secured to its interior wall.

The structure of FIG. 7 is provided for drawers having a front panel 12 that is reinforced with a second front panel. FIGS. 8A and 8B depict the second front panel 12*a*. The assembly of FIG. 8A is provided when there is a single cabinet face 13*a* and the assembly of FIG. 8B is provided when there is a double cabinet face 13*a*, 13*b*.

More particularly, bracket 18 in the embodiment of FIG. 7 includes second horizontal section 22*a* that overlies the top wall of reinforcing panel or wall 12*a* (FIGS. 8A and 8B) and it also includes second vertical wall 24*b* that overlies the interior wall of reinforcing panel or wall 12*a*. In all other respects, the embodiment of FIG. 7 is similar to the embodiment of FIG. 2B and no horizontal spacer is needed because latch 30 is positioned behind reinforcing cabinet face or wall 13*b* when said latch is extended with very little spacing between said latch 30 and said interior wall or surface of said reinforcing cabinet face or wall 13*b*. Accordingly, the provided spacer is rotated so that first arm 46*a* is in its flush position as mentioned above.

Electrical leads 29 provide electrical communication between motor 28 and a remote source of electrical power.

FIG. 7 also depicts internally threaded thumb screw-receiving opening 25 formed in second vertical wall 24*b*. A user manually tightens a thumb screw, not depicted, that engages said opening to secure bracket 18 to drawer reinforcing panel or wall 12*a*.

The structure of FIG. 8A includes spacer 44 in surmounting relation to latch 30 with fourth arm 46*d* in abutting relation to second vertical wall 24*a*. Fourth arm 46*d* abuttingly engages the interior surface of cabinet face or wall 13*a* when said latch is extended.

The structure of FIG. 8B depicts third arm 46*c* in spaced apart relation to second vertical wall 24*a*. Said FIG. 8B indicates that said third arm 46*c* will be in abutting relation to the interior surface of cabinet face or wall 13*b* when latch 30 is extended.

As best understood by comparing FIG. 7 with FIGS. 8A and 8B, motor 28 may be mounted on or under motor platform 26. If mounted below said platform, an opening is formed in said platform to accommodate latch 30.

Figure 9:
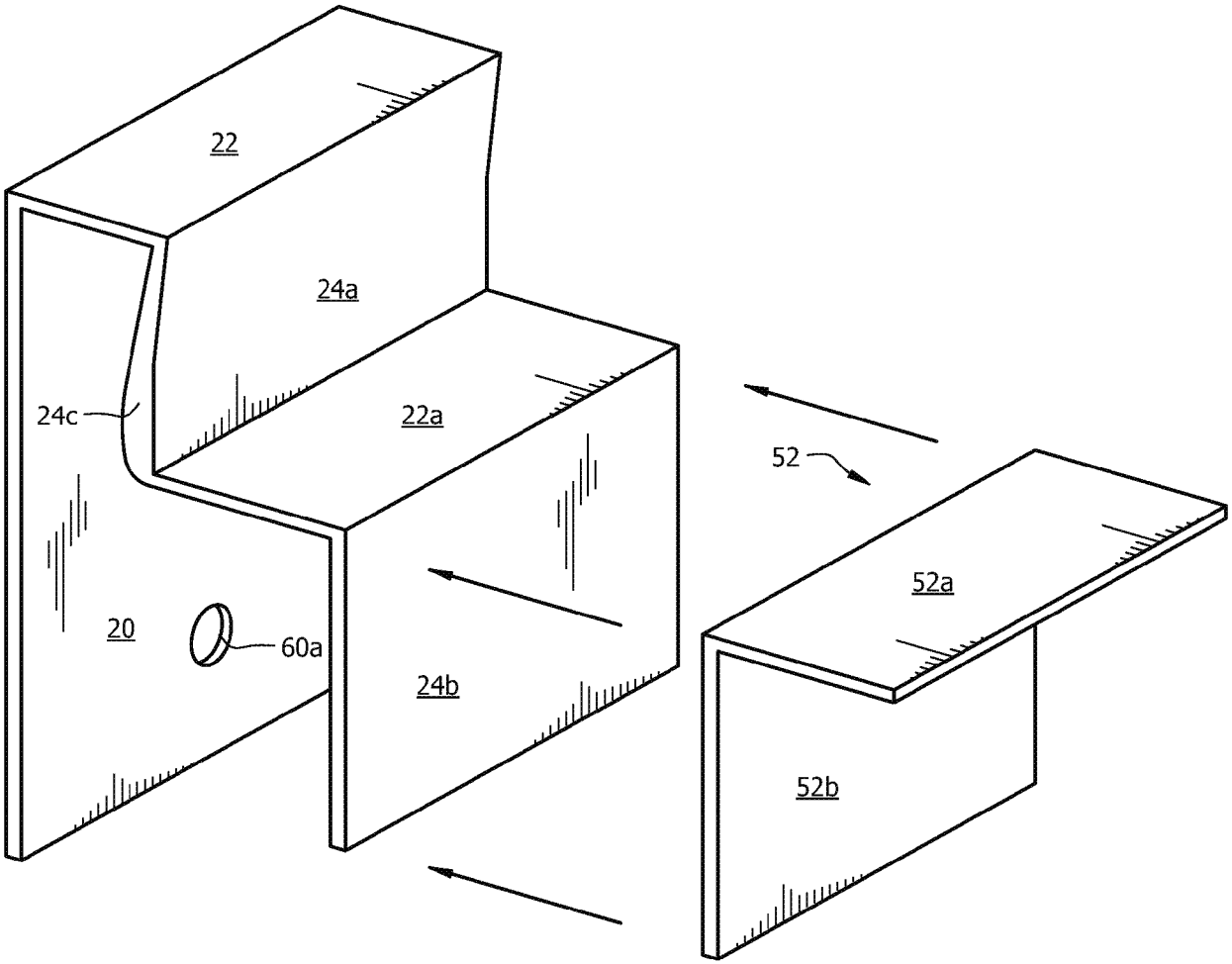
FIG. 9 is a perspective view of an alternative embodiment of the novel bracket.

Another embodiment of bracket 18 is depicted in FIG. 9. In this embodiment, vertically disposed flat back plate 24 is thickened near its lower end as at 24*c* to provide a clamping action that engages drawer panel 12. This clamping action obviates the need for thumb screw-receiving opening 25 but a thumb screw may still be provided as an optional tightening means.

Motor mount bracket 52 is provided as a separate piece that includes horizontal part 52*a* and vertical part 52*b*. Vertical part 52*b* overlies vertically disposed flat back plate 24*b* when bracket 18 is assembled. This increases the structural integrity of bracket 18. Opening 60*a* formed in bracket front wall 20 receives program set button 60, disclosed below in connection with FIG. 11A.

Figure 10:
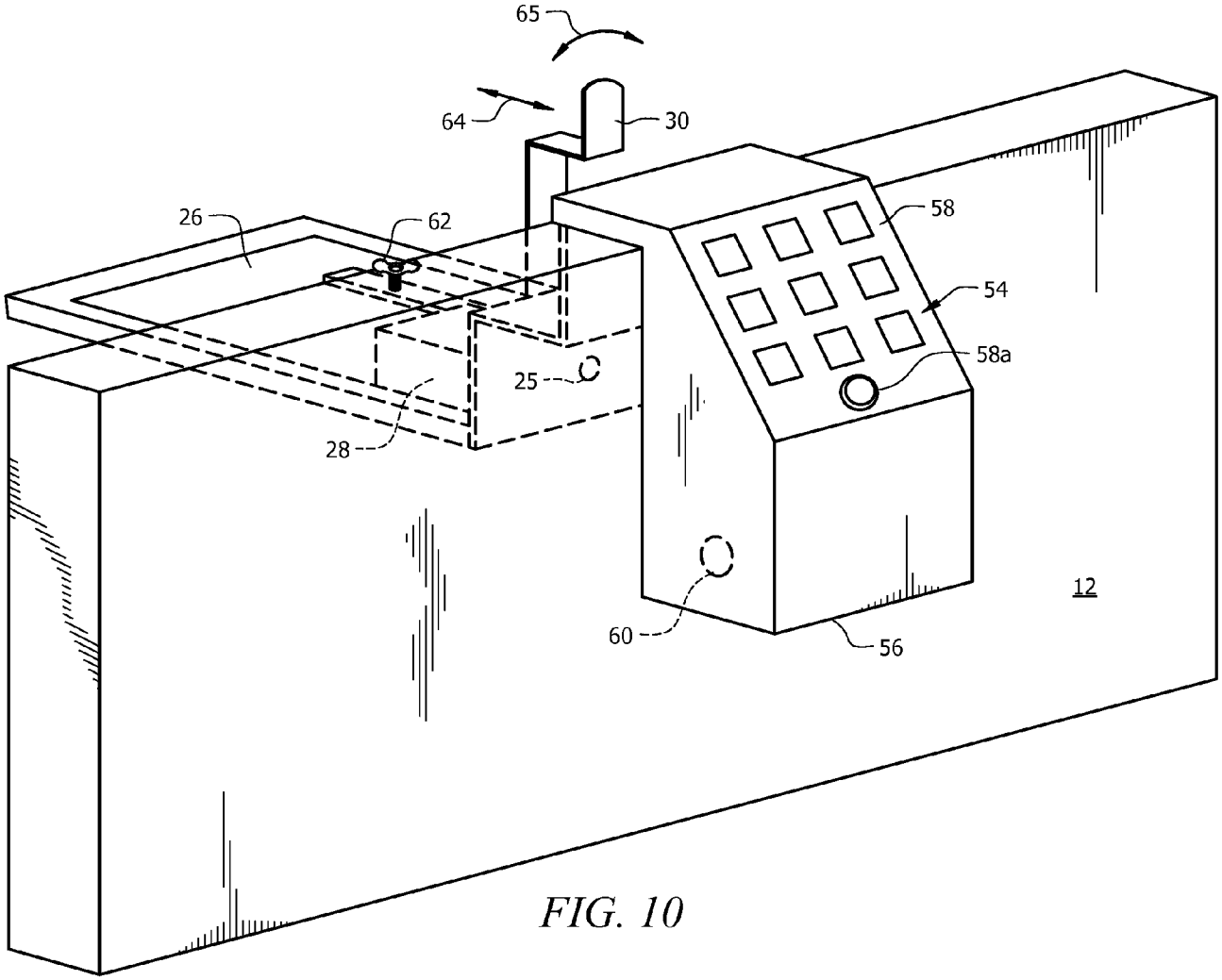
FIG. 10 is a perspective view of the invention as a whole when attached to a drawer.

FIG. 10 depicts the above-disclosed parts as well as the control means that controls the operation of motor 28 and hence latch 30. Control housing 54 includes battery compartment 56 which houses a battery or batteries, not depicted, that are in electrical communication with motor 28. Said control housing 54 is mounted to vertically disposed flat front plate 20 and includes keypad 58. The keypad includes a plurality of keys so that a predetermined number of said keys must be pressed in a predetermined sequence in order to lock or unlock the drawer. For example, a four digit code may be required. Upon successful entry of a preselected code, the user presses a key, such as center key 58*a* to lock the drawer, i.e., to send an extend latch signal to motor 28. The same or a different four digit code may be required to thereafter activate said key 58*a* so that a retract latch signal may be sent to said motor.

A program set button 60 is also provided to activate the unit. It projects towards front panel 12 from the interior face of control housing 54 and is spring-loaded so that it is depressed when control housing 54 is placed into its operative position relative to said front panel as depicted in FIG. 11A. It returns to its position of repose when control housing 54 is removed from a drawer, thereby saving battery life.

FIG. 10 also depicts yet another embodiment of a latch means. In this embodiment, latch 30 has a horizontally extending slotted base that extends into the interior of the drawer A corresponding slot is formed in motor mount platform 26 and screw 62 enables latch 30 to be tightened into any position of adjustment along the length of said slot as indicated by double-headed directional arrow 64. Latch 30 is thus positioned further into the interior of the drawer when an article of furniture such as a cabinet has a double face and said latch is moved closer to the drawer front panel if the cabinet has a single face and its position is also adjusted depending upon whether drawer panel 12 is a single panel or includes reinforcement panel 12*a*.

The output shaft of motor 28 may be adapted to rotate ninety degrees (90°) in a first direction when motor 28 is activated by an extend latch signal and ninety degrees (90°) in a second direction opposite to said first direction when the motor is activated by a retract latch signal. Such motion of latch 30 is indicated in FIG. 10 by double-headed directional arrow 65.

Figure 11:
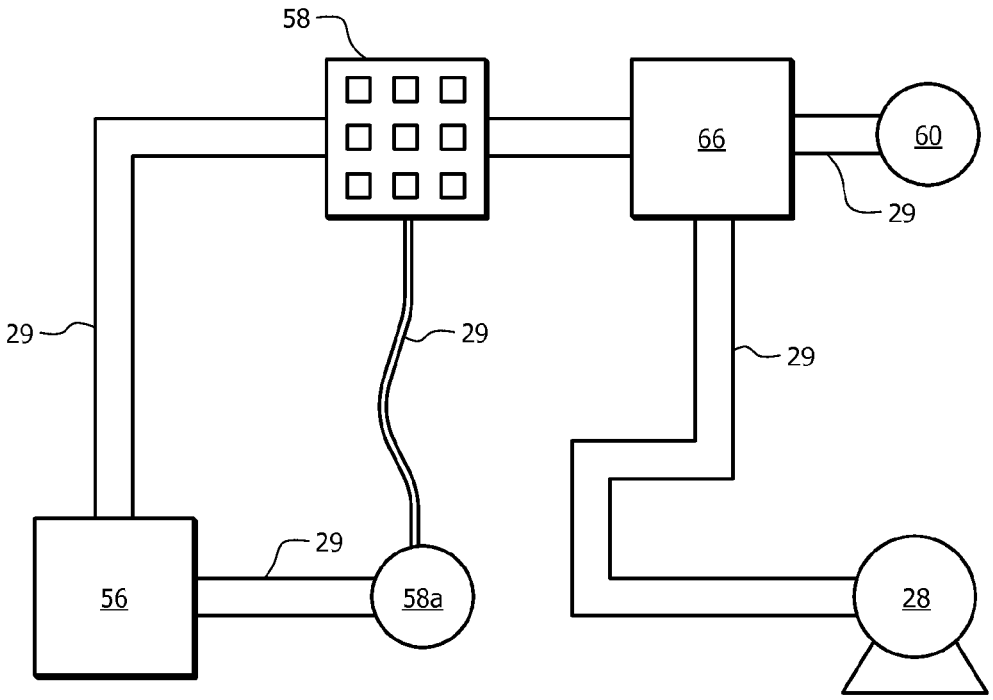
FIG. 11 is a diagrammatic representation of the control circuitry.

FIG. 11 is a schematic view depicting motor 28, battery compartment 56, keypad 58, lock button 58*a*, program set button 60, processor 66, and electrical leads 29 that provide electrical communication between said parts.

Figure 12A:
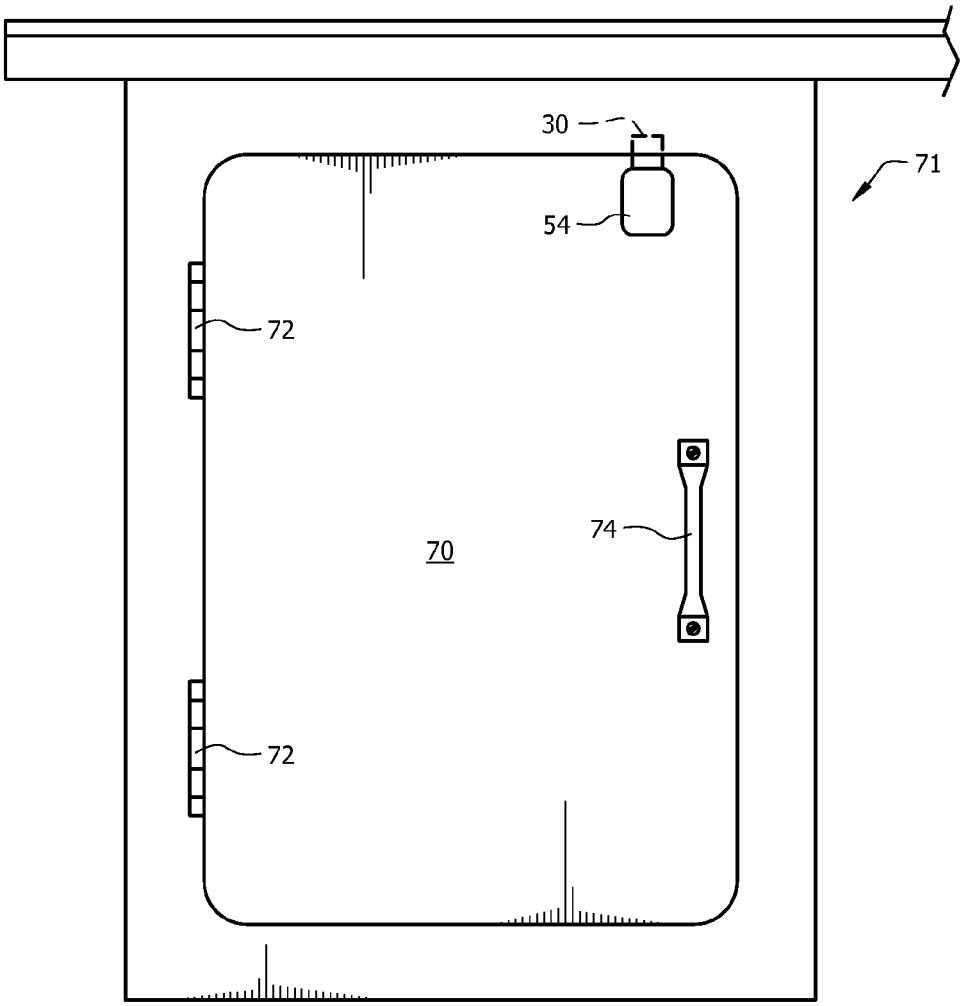
FIG. 12A depicts a first orientation of the novel structure when used on a door.
Figure 12B:
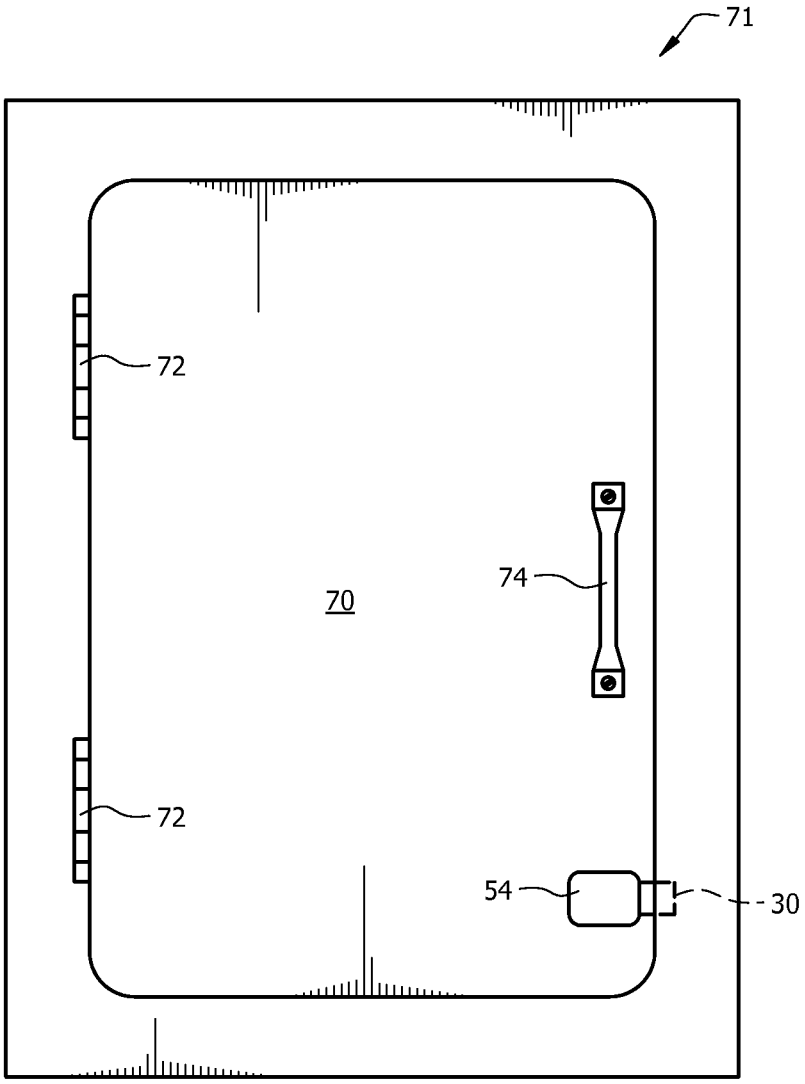
FIG. 12B depicts a second orientation of the novel structure when used on a door.

FIGS. 12A and 12B depict the novel structure when used on a door that swings about a vertical axis. Door 70 may be mounted in a floor-supported, upstanding cabinet 71 and connected to said cabinet by vertically positioned hinges 72 so that door 70 swings about said hinges in a horizontal plane when opened and closed. The door may swing inwardly or outwardly. Doorknob 74 operates in the conventional way.

Instead of a cabinet frame, the latch of the novel structure may also engage a door jamb or wall when extended.

The structure of the invention is not changed when the novel structure is used on a door instead of a drawer. Nor does the structure change when the latch engages a door jamb or a wall as distinguished from a cabinet face.

For example, the drawer-locking bracket having a vertically disposed flat front plate adapted to overlie a predetermined section of the front surface of a front panel, a horizontally disposed flat top plate adapted to overlie a horizontal top edge of said front panel, and a vertically disposed flat back plate adapted to overlie a predetermined section of an interior surface of the single front panel, is the same bracket even when oriented for use on a door so that a horizontal surface becomes a vertical surface.

It will be seen that the advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. A latch for retrofitting onto a drawer, said drawer lacking a locking means, comprising:

said latch releasably engaging an imperforate front panel of a drawer having a front surface;

said drawer adapted to slidingly engage a cabinet having a front wall;

a bracket releasably secured to said front panel, said bracket having a flat front plate adapted to overlie a predetermined section of the front surface of said front panel, a flat top plate adapted to overlie a top edge of said front panel, and a flat back plate adapted to overlie a predetermined section of an interior surface of said front panel;

said latch connected to said bracket and disposed in a vertical plane within an interior of said drawer;

said latch having a retracted position when said drawer is unlocked;

said latch having an extended position when said drawer is locked;

said latch engaging an interior surface of said front wall of said cabinet when said latch is in said extended position;

a latch actuator, connected to said bracket, disposed within an interior of said drawer, said latch actuator being manually inoperable when said drawer is closed;

a user-operated control device, disposed externally of said interior of said drawer, being in electrical communication with said latch actuator;

said latch actuator extending said latch upon receipt of an extend latch signal from said user-operated control device;

said latch actuator retracting said latch upon receipt of a retract latch signal from said user-operated control device;

said latch and said bracket causing no structural modification to said drawer when attached to and detached from said drawer;

said latch providing a locking means for said drawer when said bracket is attached to said drawer.

2. The latch of claim 1, further comprising:

said latch actuator being a motor having an output shaft, said latch being engaged by said output shaft so that activation of said motor causes displacement of said latch from said retracted position to said extended position or from said extended position to said retracted position.

3. The latch of claim 1, further comprising:

said latch actuator being a solenoid having an armature, said latch being engaged by said armature so that activation of said solenoid causes displacement of said latch from said retracted position to said extended position or from said extended position to said retracted position.

4. The latch of claim 1, further comprising:

an opening formed in said flat back plate; and a screw disposed in said opening that engages said flat back plate when tightened;

whereby said bracket fits over said front panel and is secured thereto by said screw.

5. The latch of claim 1, further comprising:

a spacer disposed in surmounting relation to said latch and releasably engaged to said latch in non-rotating relation thereto;

said spacer having a first part that engages said latch and at least one additional part that extends from said latch to an interior surface of said front wall of said cabinet when said latch and said interior surface of said front wall are spaced apart from one another.

6. The latch of claim 5, further comprising:

said spacer having an irregular "T"-shape, including a first arm having no length, a second arm having a first length, a third arm having a second length that exceeds said first length, and a fourth arm having a third length that exceeds said second length;

said latch having a square transverse cross-section and therefore having first, second, third and fourth sidewalls, each sidewall being disposed at a right angle to its contiguous sidewalls;

said latch having a bore formed therein coincident with a vertical axis of said latch;

said first part of said spacer being a rod that is slideably and non-rotatably received within said bore in a first position where said first arm having no length is aligned with said first sidewall of said latch so that said first arm abuts said interior surface of said front wall;

said rod also being slideably and non-rotatably received within said bore in a second position where said second arm is aligned with said first sidewall of said latch so that said second arm extends to and abuts said interior surface of said front wall;

said rod also being slideably and non-rotatably received within said bore in a third position where said third arm is aligned with said first sidewall of said latch so that said third arm extends to and abuts said interior surface of said front wall;

said rod also being slideably and non-rotatably received within said bore in a fourth position where said fourth arm is aligned with said first sidewall of said latch so that said fourth arm extends to and abuts said interior surface of said front wall;

said spacer being in said first position when said latch is disposed in abutting relation to said interior surface of said front wall;

said spacer being in said second position when said latch is spaced a first distance from said interior surface of said front wall;

said spacer being in said third position when said latch is spaced a second distance from said interior surface of said front wall, said second distance exceeding said first distance; and said spacer being in said fourth position when said latch is spaced a third distance from said interior surface of said front wall, said third distance exceeding said second distance.

7. The latch of claim 1, further comprising:

said latch actuator being a motor having an output shaft;

said latch being internally threaded;

an externally threaded rod secured to said output shaft of said motor for conjoint rotation therewith;

said externally threaded rod engaging internal threads formed in said latch;

said latch being extended when said output shaft rotates in a first direction; and said latch being retracted when said output shaft rotates in a second direction opposite to said first direction.

8. The latch of claim 1, further comprising:

a motor platform connected to said flat back plate;

a motor mounted on said motor platform;

said motor platform extending into an interior of the drawer for a predetermined distance.

9. The latch of claim 8, further comprising:

a spring positioned between said motor platform and said motor;

said motor being in a position of repose when said spring is in a position of repose so that if said latch is obstructed and cannot be extended to a position where it is adapted to bar movement of a drawer, the motor is driven against the bias of said spring so that the motor is not damaged.

10. The latch of claim 1, further comprising:

said latch actuator being a motor having an output shaft;

an externally threaded helical gear secured to said output shaft of said motor for conjoint rotation therewith;

a plurality of rack teeth formed in said latch;

a pinion gear disposed in meshing engagement with said rack teeth;

said pinion gear also meshingly engaged with said external threads formed in said helical gear so that said latch is extended when said output shaft rotates in a first direction and so that said latch is retracted when said output shaft rotates in a second direction opposite to said first direction.

11. The latch of claim 1, further comprising:

said flat back plate being thickened near a lower end thereof to provide a clamping action that engages said front panel.

12. The latch of claim 2, further comprising:

a control housing;

said control housing including a battery compartment;

said control housing mounted so that it is adapted to abut said front panel;

said control housing including a user interface.

13. The latch of claim 12, further comprising:

said user interface provided in the form of a keypad having a plurality of keys;

said control housing including a controller that receives input from said keypad and produces output signals based upon said input.

14. The latch of claim 13, further comprising:

a program set button that projects from an interior face of said control housing;

said program set button being biased so that it is depressed when said control housing is adapted to be placed into its operative position relative to said front panel of said drawer and so that said program set button returns to a position of repose when said control housing is removed from said front panel.

15. The latch of claim 14, further comprising:

said output shaft of said motor rotating ninety degrees in a first direction when said motor is activated by an extend latch output signal from said control device and ninety degrees in a second direction opposite to said first direction when said motor is activated by a retract latch output signal from said control device.

16. A latch that is retrofit onto a drawer, comprising:

a drawer having an imperforate front panel reinforced by an imperforate second panel, said imperforate front panel having a front surface and said imperforate second panel having an interior surface, said first and second panels collectively forming an imperforate reinforced panel;

said drawer adapted to slidingly engage a cabinet having a front wall;

said drawer having no locking means so that said drawer can be opened without requiring a key or other unlocking means;

a bracket releasably secured to said front panel, said bracket having a flat front plate adapted to overlie a predetermined section of the front surface of said imperforate front panel, a flat top plate adapted to overlie a top edge of said imperforate front panel, a flat back plate adapted to overlie a predetermined extent of a back surface of said imperforate front panel, a flat top plate adapted to overlie a top edge of said second imperforate panel, and a flat back plate adapted to overlie a predetermined extent of the interior surface of said second imperforate panel;

said latch connected to said bracket and disposed in a vertical plane within an interior of said drawer;

said latch having a retracted position when said drawer is unlocked;

said latch having an extended position when said drawer is locked;

said latch adapted to engage an interior surface of said front wall of said cabinet when said latch is in said extended position;

a latch actuator, connected to said bracket, adapted to be disposed within an interior of said drawer, said actuator being manually inoperable when said drawer is closed;

a user-operated control device, disposed externally of said interior of said drawer, being in electrical communication with said latch actuator;

said latch actuator extending said latch upon receipt of an extend latch signal from said user-operated control device;

said actuator retracting said latch upon receipt of a retract latch signal from said user-operated control device;

whereby said drawer having no locking can be locked and unlocked by attaching said latch to said drawer;

whereby said latch is adapted to be carried by a user, adapted to be temporarily attached by said user to said drawer without alteration of said drawer, and adapted to be removed from said drawer by said user after use; and whereby said front panel remains unmodified and imperforate after said bracket is secured thereto.

17. A latch retrofitted onto a cabinet having a wall and a door mounted in said wall, comprising:

a bracket having a flat front plate that overlies a predetermined section of a front surface of said door, a flat edge plate that overlies an edge of said door, and a flat back plate that overlies a predetermined extent of a back surface of said door;

said bracket secured to said door;

said door being imperforate and said door lacking a built-in locking means;

said latch engaging an interior surface of said wall when extended so that said door cannot be opened and said latch not engaging said interior surface of said wall when retracted so that said door can be opened;

a latch actuator, connected to said bracket, disposed within an interior of said cabinet, said actuator being manually inoperable when said door is closed;

a user-operated control device, disposed externally of said interior of said cabinet, being in electrical communication with said latch actuator;

said latch actuator extending said latch upon receipt of an extend latch signal from said user-operated control device; and said latch actuator retracting said latch upon receipt of a retract latch signal from said user-operated control device.

18. A latch retrofitted onto a drawer, comprising:

said latch releasably engaging an imperforate front panel of a drawer having a front surface;

said drawer slidingly engaging a cabinet having a front wall;

a bracket releasably secured to said front panel, said bracket having a flat front plate adapted to overlie a predetermined section of the front surface of said front panel, a flat top plate adapted to overlie a top edge of said front panel, and a flat back plate adapted to overlie a predetermined section of an interior surface of said front panel;

said latch connected to said bracket and disposed in a vertical plane within an interior of said drawer;

said latch having a retracted position when said drawer is unlocked;

said latch having an extended position when said drawer is locked;

said latch engaging an interior surface of said front wall of said cabinet when said latch is in said extended position;

a latch actuator, connected to said bracket, disposed within an interior of said drawer, said latch actuator being manually inoperable when said drawer is dosed;

a user-operated control device, disposed externally of said interior of said drawer, being in electrical communication with said latch actuator;

said latch actuator extending said latch upon receipt of an extend latch signal from said user-operated control device;

said latch actuator retracting said latch upon receipt of a retract latch signal from said user-operated control device;

a spacer disposed in surmounting relation to said latch and releasably engaged to said latch in non-rotating relation thereto;

said spacer having a first part that engages said latch and at least one additional part that extends from said latch to an interior surface of said front wall of said cabinet when said latch and said interior surface of said front wall are spaced apart from one another;

said spacer having an irregular "T"-shape, including a first arm having no length, a second arm having a first length, a third arm having a second length that exceeds said first length, and a fourth arm having a third length that exceeds said second length;

said latch having a square transverse cross-section and therefore having first, second, third and fourth sidewalls, each sidewall being disposed at a right angle to its contiguous sidewalls;

said latch having a bore formed therein coincident with a vertical axis of said latch;

said first part of said spacer being a rod that is slideably and non-rotatably received within said bore in a first position where said first arm having no length of said spacer is aligned with said first sidewall of said latch so that said first arm abuts said interior surface of said front wall;

said rod also being slideably and non-rotatably received within said bore in a second position where said second arm of said spacer is aligned with said first sidewall of said latch so that said second arm extends to and abuts said interior surface of said front wall;

said rod also being slideably and non-rotatably received within said bore in a third position where said third arm of said spacer is aligned with said first sidewall of said latch so that said third arm extends to and abuts said interior surface of said front wall;

said rod also being slideably and non-rotatably received within said bore in a fourth position where said fourth arm of said spacer is aligned with said first sidewall of said latch so that said fourth arm extends to and abuts said interior surface of said front wall;

said spacer being in said first position when said latch is disposed in abutting relation to said interior surface of said front wall;

said spacer being in said second position when said latch is spaced a first distance from said interior surface of said front wall;

said spacer being in said third position when said latch is spaced a second distance from said interior surface of said front wall, said second distance exceeding said first distance; and said spacer being in said fourth position when said latch is spaced a third distance from said interior surface of said front wall, said third distance exceeding said second distance.

* * * * *